US006689725B1

(12) United States Patent
Gao

(10) Patent No.: US 6,689,725 B1
(45) Date of Patent: Feb. 10, 2004

(54) LUBRICANT COMPOSITION FOR DIESEL ENGINES

(75) Inventor: Jason Zhisheng Gao, Rose Valley, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 10/069,837

(22) PCT Filed: Oct. 17, 2000

(86) PCT No.: PCT/IB00/01554

§ 371 (c)(1), (2), (4) Date: Jun. 11, 2002

(87) PCT Pub. No.: WO01/29157

PCT Pub. Date: Apr. 26, 2001

(30) Foreign Application Priority Data

Oct. 19, 1999 (GB) ..... 9924756

(51) Int. Cl.[7] ..... C10M 135/18
(52) U.S. Cl. ..... 508/364; 508/363
(58) Field of Search ..... 508/364, 363

(56) References Cited

U.S. PATENT DOCUMENTS

| | | | | |
|---|---|---|---|---|
| 3,707,498 A | * | 12/1972 | Milsom | 508/364 |
| 3,988,249 A | * | 10/1976 | Gencarelli et al. | 508/363 |
| 5,576,273 A | * | 11/1996 | Karol et al. | 508/364 |
| 5,696,063 A | * | 12/1997 | Tokashiki et al. | 508/363 |
| 5,736,493 A | * | 4/1998 | Garmier | 508/491 |
| 5,990,055 A | * | 11/1999 | Garmier | 508/491 |
| 6,048,826 A | * | 4/2000 | Ikeda et al. | 508/364 |

* cited by examiner

*Primary Examiner*—Jacqueline V. Howard
(74) *Attorney, Agent, or Firm*—Norby L. Foss

(57) ABSTRACT

This invention relates to a method of controlling the soot induced viscosity increase of a diesel engine lubricant composition comprising a base oil and a dispersant, by including in said lubricant composition an effective amount of an antioxidant, characterised in that the antioxidant comprises a dihydrocarbyldithiocarbamate of a metal selected from antimony, bismuth and mixtures thereof. The antioxidant may optionally contain at least one other compound selected from a phenolic and an aminic compound. The method of the present invention improves the performance retention of the dispersant additive, and thus inhibits the soot-induced viscosity increase of the lubricant.

11 Claims, No Drawings

LUBRICANT COMPOSITION FOR DIESEL ENGINES

This application is a 371 of PCT/IB00/01554 filed Oct. 17, 2000.

This invention relates to lubricants suitable for use in diesel engines and to a method of controlling the viscosity of such lubricants in the presence of soot.

Internal combustion engines function by the combustion of fuels which in turn generate the power needed to propel vehicles. In the case of a diesel engine, the fuel is a diesel fuel and the combustion thereof generally results in emissions from the exhausts of such vehicles which comprise three main components. These are: soot and particulate matter, carbon monoxide and nitrogen oxides (the latter will hereafter be abbreviated as NOx for convenience). To alleviate environmental concerns, research is ongoing in the petroleum industry to reduce the levels of these emissions. NOx emissions can be reduced by lowering the temperature at which the fuel is combusted in the engine. Typically this is achieved by retarding the combustion, ie by injecting the fuel shortly after the peak temperature is reached in the cylinder. However, this retarded combustion has the disadvantage that it causes more soot to accumulate in the fuel partly due to incomplete combustion of the fuel because of the lower combustion temperature, and partly due to increased soot deposition on the cylinder wall which is drawn down into to lubricant with the downward stroke of the piston. The presence of soot in the lubricant has the adverse affects of causing viscosity increase and accelerated wear. It is important that soot induced viscosity increase be controlled such that the lubricant stays within viscosity grade in order to maintain its expected performance. Several methods have been tried to alleviate this problem including the use of one or more of dispersants, metal salts and solvents which may be ethers, esters and the like. The dispersants function by forming a coating of the dispersant on the surface of soot particles and thereby minimising the tendency of the soot particles to agglomerate. However, the potency of the dispersants to perform this function, in turn, declines with time and thus, one of the methods of improving the useful life of lubricants, particularly crankcase lubricants, would be to improve the dispersancy retention capability of crankcase lubricants. This may be achieved, eg by minimising the risk of oxidation of the dispersants under the conditions prevalent in the engines during use. One such method is described in U.S. Pat. No. 5,837,657 which discloses a method of improving the performance of a sooted diesel oil and controlling soot induced viscosity increase by adding to the diesel oil a minor amount of a trinuclear molybdenum compound of the generic formula $MO_3S_kL_nQ_z$ wherein L is a ligand having organo groups, n is from 1 to 4, k various from 4 through 10, Q is a neutral electron donating compound such as eg water, amines, alcohols, phosphines and ethers, and z ranges from 0 to 5.

An object of the present invention is to achieve a method of controlling soot induced viscosity increase in lubricants by prolonging the effective performance of the dispersant additive contained in the lubricant. The dispersant is then able to disperse the soot for an extended period thereby inhibiting soot induced viscosity increase of the lubricant. In other words, an object of the present invention is to improve the dispersancy retention capability of such lubricants.

Accordingly, the present invention provides a method of controlling the soot induced viscosity increase of diesel engine lubricant compositions comprising a base oil and a dispersant by including in said lubricant composition an effective amount of an antioxidant, characterised in that the antioxidant comprises a dihydrocarbyldithiocarbamate of a metal selected from antimony, bismuth and mixtures thereof.

The lubricant compositions used in the present invention are those that comprise a major amount of a lubricating oil suitable for use in a engine crankcase, particularly a diesel engine crankcase. Thus, mineral or synthetic lubricating oils having a kinematic viscosity of 3.5 to 25 cSt at 100° C. comprise a major portion of the lubricating compositions. Such lubricating base oils are widely available and may be any of the available base oils groups, namely Group I, II, III, IV or V. Preferably the base oil is a Group I or II base oil.

The dispersancy retention properties of such lubricant compositions is improved in accordance with this invention by including in the crankcase lubricant an added antioxidant which is a metal dihydrocarbyldithiocarbamate wherein the metal is antimony or bismuth. The antioxidant may be oil soluble or oil dispersible, but is preferably oil soluble. Such dihydrocarbyldithiocarbamates and methods of preparation thereof are claimed and described for instance in prior published U.S. Pat. No. 4,859,787 and U.S. Pat. No. 5,840,664 which are incorporated herein by reference. Thus, antimony dihydrocarbyldithiocarbamate can be prepared by the use of the following reaction:

$$(R)(R')N—H+6CS_2+Sb_2O_3 \rightarrow 2[(R)(R')N—C(S)S]_3Sb+3H_2O$$

wherein R and R' are linear or branched alkyl groups.

Bismuth dihydrocarbyldithiocarbamates can be prepared by an exchange reaction between a bismuth compound such as eg a carboxylate or an alkanoate (eg bismuth neodecanoate, bismuth octanoate or bismuth naphthenate) and a metal dihydrocarbyldithiocarbamate such as eg zinc diamyldithiocarbamate. The metal dihydrocarbyldithiocarbamate used in this exchange reaction can be pre-prepared or formed in situ, for instance, by reacting a secondary amine and carbon disulphide in the presence of a metal oxide or a metal hydroxide.

The structure of the antimony or bismuth dihydrcarbyldithiocarbamates may be considered as having a ligand [—$S_2CN(R)(R')$] wherein the dihyrocarbyl groups, R and R' impart oil solubility to the antimony and bismuth compounds. In this instance, the term "hydrocarbyl" denotes a substituent having carbon atoms directly attached to the remainder of the ligand and are predominantly hydrocarbyl in character within the context of this invention. Such substituents include the following:

(1) hydrocarbon substituents, ie, aliphatic (for example alkyl or alkenyl), alicyclic (for example cycloalkyl or cycloalkenyl), aromatic-, aliphatic- and alicyclic-substituted aromatic nuclei and the like, as well as cyclic substituents wherein the ring is completed through another portion of the ligand (that is, any two indicated substituents may together form an alicyclic group);

(2) substituted hydrocarbon substituents, ie, those containing nonhydrocarbon groups which, in the context of this invention, do not alter the predominantly hydrocarbyl character of the substituent. Those skilled in the art will be aware of suitable groups (eg halo (especially chloro), amino, alkoxyl, mercapto, alkylmercapto, nitro, nitroso, sulphoxy etc.); and (3) hetero substituents, ie, substituents which, while predominantly hydrocarbon in character within the context of this invention, contain atoms other than carbon present in a chain or ring otherwise composed of carbon atoms.

The hydrcarbyl groups are preferably alkyl (e.g, in which the carbon atom attached to the remainder of the ligand is primary, secondary or tertiary), aryl, substituted aryl and ether groups.

Importantly, the hydrocarbyl groups of the ligands should be such that they have a sufficient number of carbon atoms to render the corresponding antimony or bismuth dialkyldithiocarbamate soluble or dispersible in the oil to which it is added. The total number of carbon atoms present among all of the hydrocarbyl groups of the compounds' ligands is suitably at least 21, preferably at least 25 and preferably at least 30, typically e.g., 21 to 800. For instance, the number of carbon atoms in each hydrocarbyl group will generally range from 1 to 100, preferably from 1 to 40 and more preferably from 3 to 20.

The antioxidant in the compositions of the present invention suitably also include at least one of a phenolic antioxidant and an aminic antioxidant. Among the phenolic antioxidants, hindered phenols are preferred.

Thus, according to a further embodiment, the present invention is a diesel engine lubricant composition comprising a base stock, a dispersant and an antioxidant comprising two or more of (a) an antimony dihydrocarbyldithiocarbamate, (b) a bismuth dihydrocarbyldithiocarbamate, (c) a phenolic compound and (d) an aminic compound. The nature of the antimony and bismuth dihydrocarbyldithiocarbamates in these compositions is described above. The nature and amounts of the phenolic and aminic compounds in said compositions are described below.

Examples of such phenolic compounds include inter alia:

4,4'-methylene bis(2,6-di-tert-butylphenol)

4,4'-bis(2,6-di-tert-butylphenol)

4,4'-bis(2-methyl-6-tert-butylphenol)

2,2'-methylene bis(4-ethyl-6-tert-butylphenol)

2,2'-methylene bis(4-methyl-6-tert-butylphenol)

4,4'-butylidene bis(3-methyl-6-tert-butylphenol)

4,4'-isopropylidene bis(2,6-di-tert-butylphenol)

2,2'-methylene bis(4-methyl-6-nonylphenol)

2,2'-isobutylidene bis(4,6-dimethyl phenol)

2,2'-methylene bis(4-methyl-6-cyclohexylphenol)

2,6-di-tert-butyl-4-methylphenol 2,6-di-tert-butyl-4-ethylphenol and 2,4-dimethyl-6-tert-butylphenol The phenolic antioxidants are preferably compounds which have the following structures:

(I)

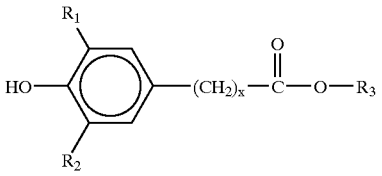

(II)

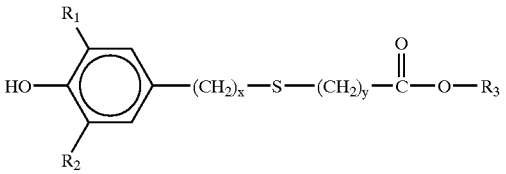

-continued (III)

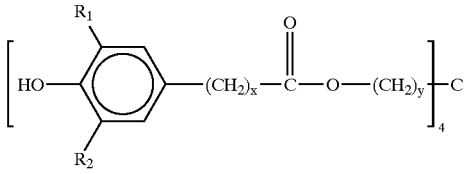

(IV)

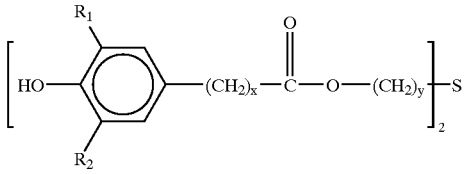

wherein, in the formulae (I)–(IV) above, $R_1$, $R_2$, and $R_3$ are the same or different alkyl groups having 3–9 carbon atoms and x and y are integers from 1 to 4.

Suitable amine antioxidants for use in the compositions of the present invention are diaryl amines, aryl naphthyl amines and alkyl derivtives of diaryl amines and the aryl naphthyl amines. Specific examples of the aminic compounds that may be used in the compositions of the present invention include inter alia:

Monoalkyldiphenyl amines such as eg monooctyldiphenyl amine and monononyl diphenyl amine; dialkyldiphenyl amines such as eg 4,4'-dibutyldiphenyl amine, 4,4'-dipentyldiphenyl amine, 4,4'-dihexyldiphenyl amine, 4,4'-diheptyldiphenyl amine, 4,4'-dioctyldiphenyl amine and 4,4'-dinonyldiphenyl amine; polyalkyldiphenyl amines such as eg tetra-butyldiphenyl amine, tetra-hexyldiphenyl amine, tetra-octyldiphenyl amine and tetra-nonyldiphenyl amine; the naphthylamines such as eg α-naphthylamine and phenyl-α-naphthylamine; butylpheny-α-naphthylamine, pentylphenyl-α-naphthylamine, hexylphenyl-α-naphthylamine, heptylphenyl-α-naphthylamine, octylphenyl-α-naphthylamine and nonylphenyl-α-naphthylamine. Of these, dialkyldiphenyl amine and naphthylamines are preferable.

In general the antioxidant which comprises the dihydrocarbyldithiocarbamates of antimony and/or bismuth and optionally phenolic and/or aminic compounds will form a minor component of the total lubricant composition. For example, the antimony or bismuth dihydrocarbyldithiocarbamate typically will comprise about 0.05 to about 3 wt %, preferably about 0.1–2% of the total composition, ie the antimony and/or bismuth metal is suitably present in an amount of about 50–2000 ppm, preferably from about 200–1500 ppm of the total composition. The optional phenolic and/or aminic compounds are suitably present in an amount of about 0.1 to about 3 wt % of the total composition.

It has also been found that if the weight ratio of antimony and/or bismuth dihydrocarbyldithiocarbamate to the phenolic or aminic compound in the antioxidant is in the range of about 80:20 to about 20:80, optimum dispersancy retention can be achieved by these combined additives of the present invention.

It is particularly preferred that the antioxidant comprises in addition to the antimony and/or bismuth dihydrocarbyldithiocarbamate a mixture of hindered phenols and a diaryl amine in a weight ratio ranging from about 20–80:10–60:10–60 respectively.

Optionally, the antioxidants may be combined with a carrier liquid in the form of a concentrate. The concentration of the combined antioxidants in the concentrate may vary from 1 to 80% by weight, and will preferably be in the range of 5 to 10% by weight.

Any of the conventional dispersants used hitherto in the lubricating compositions may also be used in the compositions of the present invention. Examples of these include the polyalkylene succinimides, Mannich condensation products of polylalkylphenolformaldehyde polyamine and borated derivatives thereof. However, it is preferable to use ashless dispersants such as the ashless succinimides, especially the polyisobutenyl succinimides of a polyamine such as eg tetraethylenepentamine, benzylamine ashless dispersants, and ester ashless dispersants. The dispersants are generally used in the compositions of the present invention in an amount ranging from about 1–10% by weight based on the total weight of the lubricant composition, preferably from about 4–8% by weight.

In general, these lubricating compositions may include additives commonly used in lubricating oils especially crankcase lubricants, such as antiwear agents, detergents, rust inhibitors, viscosity index improvers, extreme-pressure agents, friction modifiers, corrosion inhibitors, emulsifying aids, pour point depressants, anti-foams and the like.

A feature of the lubricant compositions of the present invention is that the presence therein of antimony and/or bismuth dihydrocarbyldithiocarbamate as an antioxidant provides unexpected improvement in oxidation control, viscosity increase control and dispersancy retention over compositions which contain conventional organomolydenum compounds such as the corresponding dinuclear molybdenum dihydrocarbyldithiocarbamates.

The present invention is further illustrated with reference to the following Examples and Comparative Tests.

EXAMPLES

Examples A–F

General Procedure

A series of test oils were prepared, each oil consisting of 600 Solvent Neutral ('600 SN') mineral base oil, a dispersant additive, and, apart from the control Test Oil A, one or more specified antioxidant additives, as shown in Table 1 below. The KV100 of each of these fresh Test Oils was measured and the measurements are given in Table 2 below. Test Oils B and D demonstrate the present invention; Test Oils A, C, E and F are comparative.

The dispersancy retention of each of the Test Oils was determined by use of a GM 6.2 L soot-laden basestock dispersancy test in which the soot dispersancy of an used oil is determined by the viscosity ratio of the diluted test oil in the presence and absence of soot; the lower the ratio, the better the dispersancy.

To provide soot-containing oils for the test, the fresh Test Oils of Table 1 were each mixed with a soot-laden mineral oil—600 SN containing 3.5 wt % soot—at a weight ratio of 25:75 Test Oil to to soot-laden 600 SN oil. The $KV_{100}$ of each of the fresh Test Oil/soot-laden 600 SN mixtures was measured and the measurements are given in Table 2 below. To determine the effect of the soot on the oil viscosity, the $KV_{100}$ measurements of the soot-laden mixtures were compared with the $KV_{100}$ of the equivalent oils without soot. The $KV_{100}$ of these fresh Test Oil/fresh 600 SN, 'KV(mix)', was calculated according to the equation:

$$KV_{100}(\text{mix})=25\%\ KV_{100}(\text{fresh Test Oil})+75\%\ KV_{100}(\text{fresh 600 SN})$$

where the $KV_{100}$ of the fresh 600 SN is known to be 11.2 cSt. These measurements are also given in Table 2 below. The effect of the soot on the oil viscosity is expressed by the relative viscosity of the fresh Test Oil/soot-laden 600 SN to the viscosity of the equivalent fresh Test Oil/fresh 600 SN mixture. The relative viscosity is given in the bottom line of Table 2.

To determine the effective dispersancy retention capabalities of the Test Oils, each of the above oils was then subjected to a bench oxidation test. In this test, the oil was exposed for 32 hours at 165° C. under a mixed nitrogen/air flow, with 40 ppm iron from added ferric acetylacetonate as catalyst. The flow rates of air and nitrogen were controlled at 500 ml/min and 350 ml/min respectively. The $KV_{100}$ of these 'used' oils were then measured for (i) the Test Oils of Table 1 alone, (ii) the Test Oil/soot-laden 600 SN oil, and (iii) the Test Oil/'unsooted' 600 SN oil. These $KV_{100}$ measurements are given in Table 3 below. The relative viscosity of each used Test Oil/unsooted 600 SN oil to equivalent used Test Oil/soot-laden 600 SN oil was calculated and these relative viscosities are given in the bottom line of Table 3.

In these Examples and tests the following commercial materials have been used:

Irganox® L150 is a mixture of phenolic and diarylamine (ex Ciba Geigy)

Paranox® 106 is a polyisobutenylsuccinimide dispersant (ex Infenium, Linden, N.J.)

Octopol® 735 is an antimony diamyldithiocarbamate (containing 7.5% antimony, ex Tiarco Chemical, Dalton Ga., USA).

Molyvan® 822 is a dinuclear molybdenum dithiocarbamate containing 5% Mo (ex R T Vanderbilt Co) used in Tests E & F The compositions of the Test oils A–F are shown in Table 1 below:

TABLE 1

| Test Oils | A | B | C | D | E | F |
|---|---|---|---|---|---|---|
| 600SN (% wt) | 94.0 | 93.0 | 93.0 | 93.0 | 93.0 | 91.8 |
| Paranox ® 106 (% wt) | 6.0 | 6.0 | 6.0 | 6.0 | 6.0 | 6.0 |
| Irganox ® L150 (% wt) | — | — | 1.0 | 0.5 | — | — |
| Octopol ® 735 (% wt) | — | 1.0 | — | 0.5 | — | — |
| Molyvan ® 822 | — | — | — | — | 1.0 | 2.2 |

The characteristics of the fresh Test oils (A–F) are shown in Table 2 below:

TABLE 2

| Test Oils | A | B | C | D | E | F |
|---|---|---|---|---|---|---|
| Fresh Oil $KV_{100}$ (cSt) | 12.99 | 12.98 | 13.02 | 12.98 | 12.98 | 12.98 |
| $KV_{100}$ of Fresh Oil/Soot-Laden 600SN (3.5 wt % soot) Mixture (25/75) (cSt) | 14.29 | 14.13 | 14.24 | 14.13 | 14.16 | 14.17 |
| Calculated $KV_{100}$ of Fresh oil/Fresh 600SN Mixture (25/75) (cSt) | 11.70 | 11.70 | 11.71 | 11.70 | 11.70 | 11.70 |
| Relative Viscosity (Viscosity Ratio), $\eta_r$ (Fresh oil) | 1.22 | 1.21 | 1.22 | 1.21 | 1.21 | 1.21 |

Table 3 below shows the characteristics of the used oils (A–F) after the oxidation test.

TABLE 3

| Test Oils | A | B | C | D | E | F |
|---|---|---|---|---|---|---|
| Used Oil $KV_{100}$ (cSt) | 35.40 | 13.33 | 14.16 | 13.34 | 17.44 | 14.70 |
| $KV_{100}$ of Used Oil/Soot-Laden 600SN (3.5 wt % soot) Mixture (25/75) (cSt) | 21.82 | 14.64 | 16.44 | 14.45 | 17.25 | 16.52 |
| Calculated $KV_{100}$ of Used oil/Fresh 600SN Mixture (25/75) (cSt) | 14.65 | 11.75 | 11.87 | 11.73 | 12.43 | 12.01 |
| Relative Viscosity (Viscosity Ratio), $\eta_r$ (Used oil) | 1.49 | 1.25 | 1.39 | 1.23 | 1.39 | 1.38 |

The extent to which the test oil has been subject to soot-induced viscosity increase over time, ie after being exposed to oxidative conditions, is shown by a comparison of the relative viscosity of the used oil in Table 3 with the relative viscosity of the equivalent 'fresh' oil in Table 2. The closer the relative viscosity of the used oil to the fresh oil, the smaller the viscosity increase, and hence the greater the improvement in the dispersancy retention of the lubricant. From the above results it can be seen that Test Oils B and D according to the invention show significant improvement in control of soot-induced viscosity relative to comparative Test Oils A, C, E and F. For example, Test Oil B, containing an antimony dihydrocarbyldithiocarbamate antioxidant has a used oil relative viscosity of 1.25 and a fresh oil relative viscosity of 1.21, a difference of only 0.04 indicating very little increase in viscosity; whereas comparative Test Oil E containing a molybdenum dihydrocarbyldithiocarbamate has used oil and fresh oil relative viscosities of 1.39 and 1.21 respectively, that is a much larger difference of 0.18 indicating a significant increase in viscosity of the used oil relative to the fresh oil. Test Oil D, which is a preferred embodiment of the present invention, containing both an antimony dihydrocarbyldithiocarbamate and a phenol/amine antioxidant, has a even better reduction in soot induced viscosity with a difference in used oil versus fresh oil relative viscosity of only 0.02.

Examples G & H

Example G: 50 g of bismuth Nap-All (14% Bi, ex OMG Americas, Inc, Ohio, USA) and 54 g pf Vanlube® AZ (50% zinc diamyldithiocarbamate, ex R T Vanderbilt Co Inc, Connecticut, USA) were mixed at room temperature for 3 hours to yield a product containing bismuth diamyldithiocarbamate and zinc naphthenate by a process described in the prior published U.S. Pat. No. 5,840,664. The bismuth content in the product was 6.7%.

Example H: 35 g of bismuth salt of neodecanoic acid (20% bismuth, ex OMG Americas, Inc, Ohio, USA) and 54 g of Vanlube® (50% zinc diamyldithiocarbamate, ex R T Vanderbilt Co, Inc, Connecticut, USA) were mixed at room temperature for 3 hours to yield a product (orange/red in colour) containing bismuth diamyldithiocarbamate and zinc neodecanoate. The bismuth content in the product was 7.9%.

Examples I–N

A set of oils were formulated to provide a heavy duty diesel oil, each oil consisting of a conventional, commercially available heavy duty diesel oil (the same oil was used in each of Examples I–N) and, apart from comparitive examples I and N, one or more specified antioxidant additives. The compositions of the Test oils I–N are shown in Table 4 below:

TABLE 4

| Test Oils | I* | J | K | L | M | N* |
|---|---|---|---|---|---|---|
| 15W-40 Engine Oil (CG-4), (wt %) | 100 | 99.0 | 98.0 | 98.0 | 98.5 | 99.0 |
| Octopol ® 735 (wt %) | — | 1.0 | — | — | — | — |
| Bi Compound from Example G (wt %) | | | 2.0 | — | — | — |
| Bi Compound from Example H (wt %) | — | — | — | 2.0 | 1.0 | — |
| Irganox ® L150 (wt %) | — | — | — | — | 0.5 | 1.0 |

*Comparative test not according to the invention.

The oils were then tested for dispersancy retention using the same GM 6.2 L soot-laden basestock dispersancy test as described for Examples A–F above, and the relative viscosities of the used and fresh oil samples determined.

The characteristics of the fresh Test oils (I–N) are shown in Table 5 below:

TABLE 5

| Test Oils | I | J | K | L | M | N |
|---|---|---|---|---|---|---|
| Fresh Oil $KV_{100}$ (cSt) | 15.10 | 14.97 | 14.88 | 14.92 | 14.97 | 15.20 |
| $KV_{100}$ of Fresh Oil/Soot-Laden 600SN (3.5 wt % soot) Mixture (25/75) (cSt) | 14.42 | 14.44 | 14.40 | 14.26 | 14.32 | 14.42 |
| Calculated $KV_{100}$ of Fresh oil/Fresh 600SN Mixture (25/75) (cSt) | 12.23 | 12.19 | 12.17 | 12.18 | 12.20 | 12.25 |
| Relative Viscosity (Viscosity Ratio), $\eta_r$ (Fresh oil) | 1.18 | 1.18 | 1.18 | 1.17 | 1.17 | 1.18 |

The following Table 6 shows the characteristics of the used oils (I–N) after the oxidation test.

TABLE 6

| Test Oils | I | J | K | L | M | N |
|---|---|---|---|---|---|---|
| Used Oil $KV_{100}$ (cSt) | 14.16 | 16.77 | 14.24 | 14.21 | 15.22 | 15.86 |
| $KV_{100}$ of Used Oil/Soot-Laden 600SN (3.5 wt % soot) Mixture (25/75) (cSt) | 16.15 | 15.04 | 15.01 | 15.51 | 14.57 | 15.69 |
| Calculated $KV_{100}$ of Used oil/Fresh 600SN Mixture (25/75) (cSt) | 11.89 | 12.49 | 11.84 | 11.94 | 12.14 | 12.28 |
| Relative Viscosity (Viscosity Ratio), $\eta_r$ (Used oil) | 1.36 | 1.20 | 1.26 | 1.30 | 1.20 | 1.28 |

These results show that bismuth and antimony dialkyldithiocarbamates can be used as a top treat for a fully formulated 15W-40 heavy duty diesel engine oil. The addition of antimony dialkyldithiocarbamate or bismuth dialkyldithiocarbamate/Irganox® L150 mixture leads to a substantially improved reduction is soot-induced viscosity increase and hence an improvement in dispersancy retention capability.

What is claimed is:

1. A method of controlling the soot induced viscosity increase of a lubricant composition used in a diesel engne comprising:

operating said diesel engine under $NO_x$ emissions reducing conditions thereby increasing spot concentration in said lubricant composition, and including in said lubricant composition a base oil and a dispersant, and including in said lubricant composition an effective amount of an oil soluble dihydrocarbyldithiocarbamate of a metal, said metal selected from the group consisting of antimony, bismuth or combinations thereof, thereby controlling said soot induced viscosity increase of said lubricant.

2. The method according to any one of claim 1 wherein said dihydrocarbyldithiocarbamate of antimony and/or bismuth is provided to said lubricant composition at about 0.05 to about 3.00 wt % of the final mixture.

3. The method according to claim 2 wherein the hydrocarbyl groups of said antimony dihydrocarbyldithiocarbamate said bismuth dihydrocarbyldithiocarbamate are the same or different and are selected from the group consisting of:

(a) hydrocarbon substituents;

(b) substituted hydrocarbon substituents which contain nonhydrocarbon groups; and (c) hetero substituents which are characterized by hydrocarbyl groups which contain atoms other than carbon present in a chain or ring otherwise composed of carbon atoms.

4. The method according to either claim 3 wherein said hydrocarbon substituents of (a) or (b) are selected from the group consisting of aliphatic, alicyclic, aromatic, aromatic nuclei substituted by aliphatic, alicyclic or cyclic groups, and wherein the cyclic substituents are such that the ring is completed through another portion of the ligand by any two of the indicated substituents together forming an alicyclic group.

5. The method according to claim 3 wherein said nonhydrocarbon groups are selected from the group consisting of halo, amino, alkoxyl, mercapto, alkylmercapto, nitro, nitroso and sulphoxy groups.

6. The method according to claim 4 wherein said hydrocarbon substituent is selected from the group consisting of alkyl, aryl, substituted aryl and ether groups.

7. The method according to claim 4 wherein said nonhydrocarbon groups are selected from the group consisting of halo, amino, alkoxyl, mercapto, alkylmercapto, nitro, nitroso and sulphoxy groups.

8. The method according to claim 7 wherein said lubricant composition further comprises a phenolic compound and/or an amine compound wherein either individually or in combination are provided to said lubricant composition at about 0.10 to about 3.0 wt % of the total composition.

9. The method according to claim 7 wherein said lubricant composition further comprises a phenolic compound and/or an amine compound wherein either individually or in combination are provided to said lubricant composition at about 0.10 to about 3.0 wt % of the total composition.

10. The lubricant composition of any of the proceeding claims.

11. A method of controlling the soot induced viscosity increase of in a lubricant composition of in a lubricant composition used in a diesel engine comprising:

operating said diesel engine under $NO_x$ emissions reducing conditions thereby increasing soot concentration in said lubricant composition, and including in said lubricant composition a base oil, and at least one dispersant, said dispersant being selected from the group consisting of an antimony dihydrocarbyldithiocarbamate and a bismuth dihydrocarbyldithiocarbamate, or combinations thereof; and at least one antioxidant, said antioxidant being selected from the group consisting of a phenolic compound and an aminic compound wherein said antimony dihydrocarbyldithiocarbamate or said bismuth dihydrocarbyldithiocarbamate, or the combination thereof is oil soluble; and wherein the hydrocarbyl groups of said dihydrocarbyldithiocarbamate or said bismuth dihydrocarbyldithiocarbamate are the same or different and are selected from the group consisting of (a) hydrocarbon substituents, (b) substituted hydrocarbon substituents which contain nonhydrocarbon group, and (c) hetero substituents, wherein said hydrocarbon substituents of (a) or (b) are the same or different and are selected from the group consisting of aliphatic, alicyclic, aromatic, aromatic nuclei substituted by aliphatic, alicyclic or cyclic groups, and wherein the cyclic substituents are such that the ring is completed through another portion of the ligand by any two of the indicated substituents together forming an alicyclic group; and wherein said nonhydrocarbon groups are selected from the group consisting of halo, amino, alkoxyl, mercapto, alkylmercapto, nitro, nitroso and sulphoxy groups, and wherein the amount of said antimony dihydrocarbyldithiocarbamate and/or said bismuth dihydrocarbyldithiocarbamate is, individually or in combination, provided to said lubricating oil composition in an amount from about 0.05 to 3.0 wt % of the total composition, or the amount of said antimony dihydrocarbyldithiocarbamate and/or said bismuth dihydrocarbyldithiocarbamate is, individually or in combination, provided to said lubricating oil composition in an amount from about 50 to about 2000 ppm based on the antimony and/or bismuth provided to the total composition; and wherein said phenolic compound and/or said aminic compound, either individually or in combination, is provided to said lubricating oil composition at about 0.10 to about 3.0 wt % of the total composition.

* * * * *